US006021610A

United States Patent [19]

Hunt

[11] Patent Number: 6,021,610

[45] Date of Patent: Feb. 8, 2000

[54] HURRICANE FORCE WIND RESISTANT WINDOW OR DOOR WITH AESTHETIC SACRIFICIAL MEMBER AND ASSOCIATED METHODS

[75] Inventor: Daniel Hunt, Longwood, Fla.

[73] Assignee: Robert Hunt Corporation, U.S.A, Longwood, Fla.

[21] Appl. No.: 09/298,748

[22] Filed: Apr. 23, 1999

Related U.S. Application Data

[60] Provisional application No. 60/115,224, Jan. 8, 1999.

[51] Int. Cl.[7] ..... E06B 3/00

[52] U.S. Cl. ..... 49/501; 52/98; 52/100

[58] Field of Search ..... 49/501, 504, 482.1; 52/98, 100

[56] References Cited

U.S. PATENT DOCUMENTS

| | | | |
|---|---|---|---|
| 618,282 | 1/1899 | McGuire . | |
| 705,081 | 8/1902 | Hennessey . | |
| 1,505,966 | 8/1924 | Murphy . | |
| 1,820,715 | 8/1931 | Vance . | |
| 2,094,990 | 10/1937 | Lang . | |
| 2,121,094 | 6/1938 | Nuding et al. . | |
| 2,949,647 | 8/1960 | Migneault et al. . | |
| 3,069,301 | 12/1962 | Buckley et al. . | |
| 3,098,698 | 7/1963 | Glynn | 49/501 X |
| 3,111,727 | 11/1963 | Gerecke . | |
| 3,714,738 | 2/1973 | Koslow et al. | 49/404 |
| 3,787,936 | 1/1974 | Rystad | 24/262 |
| 3,900,673 | 8/1975 | Mattimoe et al. | 428/339 |
| 3,916,074 | 10/1975 | Knackstedt et al. | 428/425 |
| 3,965,638 | 6/1976 | Newman | 49/501 X |
| 4,020,217 | 4/1977 | Karasudani et al. | 428/429 |
| 4,128,694 | 12/1978 | Fabel et al. | 428/412 |
| 4,486,980 | 12/1984 | O'Bar | 49/449 |
| 4,514,464 | 4/1985 | Gomez | 428/332 |
| 4,803,808 | 2/1989 | Greisner | 49/394 |
| 4,856,239 | 8/1989 | Elsasser | 52/98 |
| 5,560,149 | 10/1996 | Lafevre | 49/501 |
| 5,713,159 | 2/1998 | Schmidt | 52/98 |
| 5,791,104 | 8/1998 | Baier et al. | 52/98 X |
| 5,894,706 | 4/1999 | Herbst | 49/501 X |

*Primary Examiner*—Jerry Redman
*Attorney, Agent, or Firm*—Allen, Dyer, Doppelt, Milbrath & Gilchrist, P.A.

[57] ABSTRACT

A window or door includes a wood sash carrying at least one reinforced transparent panel. The wood sash includes a body portion and an integrally formed aesthetic sacrificial member extending outwardly therefrom to contact the transparent panel at an interface therewith. The body portion is spaced from an adjacent portion of the transparent panel to define a cavity beneath the aesthetic sacrificial member. Sealant material is positioned in the cavity. The aesthetic sacrificial member fractures during hurricane force winds to permit the transparent panel to move within the wood sash to absorb energy of pressure cycling that occurs during hurricane force winds. The aesthetic sacrificial member also covers the body of sealant material to provide a pleasing appearance consistent with the quality of the wood sash.

14 Claims, 3 Drawing Sheets

HURRICANE FORCE WIND RESISTANT WINDOW OR DOOR WITH AESTHETIC SACRIFICIAL MEMBER AND ASSOCIATED METHODS

RELATED APPLICATION

This application is based upon prior filed copending provisional application No. 60/115,224 filed Jan. 8, 1999, the entire disclosure of which is incorporated herein by reference.

FIELD OF THE INVENTION

The present invention relates to building structures, and, more particularly, to glass doors and windows resistant to high winds, such as hurricane force winds.

BACKGROUND OF THE INVENTION

Various windows and glass doors have been developed in an effort to avoid the type of structural damage that may result from high winds, as may be experienced in a hurricane. For example, as a result of the widespread destruction caused by hurricane Andrew, new standards have been proposed in certain southern Florida counties to provide stronger windows and doors to decrease the damage to associated structures during severe storms. The glass used in wind resistant windows and doors is typically a laminated glass panel and includes at least one plastic reinforcing layer and one or more glass layers.

The new standard basically requires that the glass panel in the window or door absorb a first blow from an end of a wood 2×4 (weighing 9 lbs.) striking the center at 34 miles per hour. A second similar blow is directed to a corner area of the glass panel. Consequently, the glass panel is cracked but a large portion of the glass is retained in position to close the opening by a reinforcing plastic layer. Only a relatively small effective opening may be formed in the cracked glass panel by the 2×4 strikes. The window or door is next subjected to a pressure cycling test where positive and negative pressures are applied sequentially. A typical test would be 9,000 cycles of 75 lbs./sq. foot and −80 lbs./sq. foot. Positive indicates that the pressure is greater on the exterior of the window or door, and negative pressure indicates that the pressure on the interior of the window or door is greater. During the pressure cycling testing, the plastic film and glass in the glass panel becomes a sail and can exert relatively large forces on the window or door sash and frame members.

Unfortunately, if the window or glass door fails completely, pressures can be generated internal to the structure that may be sufficiently high to cause damage. For example, a portion or all of the roof may be blown from the structure. High quality windows and glass doors, such as those offered by Pella, for example, typically include a wood frame and wood sash and an exterior aluminum cladding material. The wood frame and sash are especially attractive, and can be shaped and painted to achieve a variety of pleasant designs.

However, the possibility of the wood window or glass door failing is further enhanced because the wood styles and rails of the sash, for example, are typically relatively thin. Thus, the problems with addressing the above mentioned hurricane standards are especially difficult for high quality wood windows and wood glass doors. One approach to absorb the flexing or movement of the glass panel when subjected to the pressure cycling is to include a relatively large body of sealant material at the interface between the interior wood sash and the glass panel. Unfortunately, the sealant material has a tendency to protrude at the interface. In addition, the sealant material typically may have a different color and/or texture than the adjacent wood. Accordingly, the pleasing aesthetic appearance of the wood sash is overshadowed by the unsightly mass of sealant material.

SUMMARY OF THE INVENTION

In view of the foregoing background, it is therefore an object of the present invention to provide a high quality wood door or window that is resistant to hurricane force winds, yet which provides a pleasing appearance consistent with the quality of the wood sash.

It is another object of the invention to provide a method for increasing the resistance of high quality wood glass doors and/or windows to such winds while providing a pleasing appearance consistent with the quality of the wood sash.

These and other objects, features and advantages in accordance with the present invention are provided by a window or door having a wood sash that carries a reinforced transparent glass and/or plastic panel. The wood sash preferably includes a body portion and an integrally formed aesthetic sacrificial member extending outwardly therefrom to contact the reinforced transparent panel at an interface therewith. The body portion is spaced from an adjacent portion of the reinforced transparent panel to define a cavity beneath the sacrificial member. A body of sealant material is in the cavity, and the aesthetic sacrificial member covers the sealant material from view. The aesthetic sacrificial member thus provides an attractive part of the wood sash, but can readily crack or fracture from the body portion to thereby permit the reinforced transparent panel to move slightly within the wood sash to thereby absorb the energy of the pressure cycling as may occur in a hurricane, for example. The sealant material permits the reinforced transparent panel to move within the wood sash, but remain carried by the wood sash to thereby reduce the likelihood of a catastrophic failure, such as the reinforced transparent panel coming completely out of the wood sash.

The aesthetic sacrificial member extends along the interior interface to hide the sealant material from view, and also to provide a smooth surface for painting. The aesthetic sacrificial member is preferably in the form of a lip which presses against the reinforced transparent panel, and which also serves to define the cavity. The cavity defined below the aesthetic sacrificial member is preferably sufficiently large to support a relatively large amount of sealant material to withstand the forces described above.

Another aspect of the invention relates to a method for making a window or glass door including the aesthetic sacrificial member as described above. The method preferably includes forming a wood sash to have a body portion and an integrally formed aesthetic sacrificial member extending outwardly to contact at least one reinforced transparent panel at an interface therewith. The body portion is spaced from an adjacent portion of the reinforced transparent panel to define a cavity beneath the sacrificial member. The method may further include the step of positioning sealant material within the cavity. The sealant material is covered from view by the aesthethic sacrificial member. The aesthetic sacrificial member fractures from the body portion during hurricane force winds to permit the reinforced transparent panel to move within the wood sash to absorb energy of pressure cycling that occurs during hurricane force winds.

DETAILED DESCRIPTION OF THE PREFERRED EMBODIMENTS

The present invention will now be described more fully hereinafter with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout.

Figure 1B:
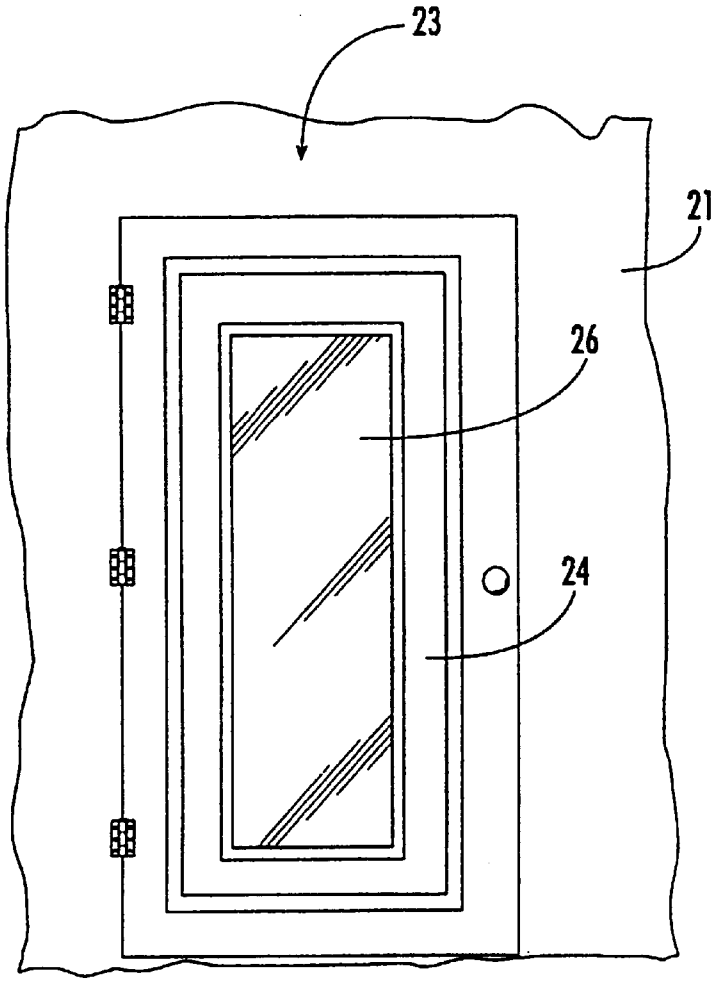
FIG. 1*a* and 1*b* are a front elevational view of a casement window and a glass door, respectively, including the aesthetic sacrificial member at the interface between the reinforced transparent panel and the wood sash according to the present invention.
Figure 1A:
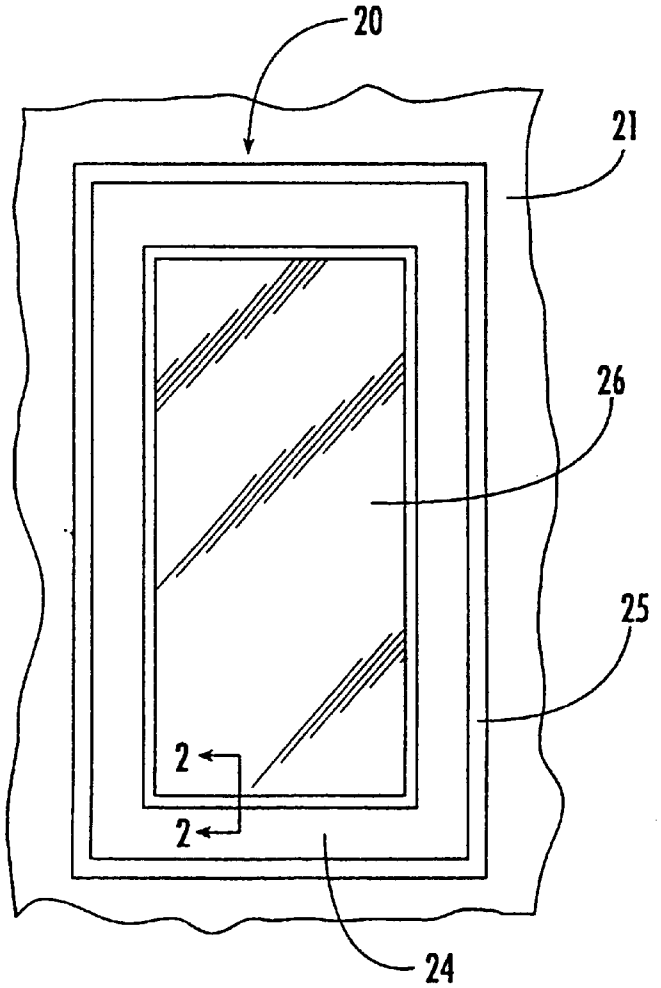
Figure 2:
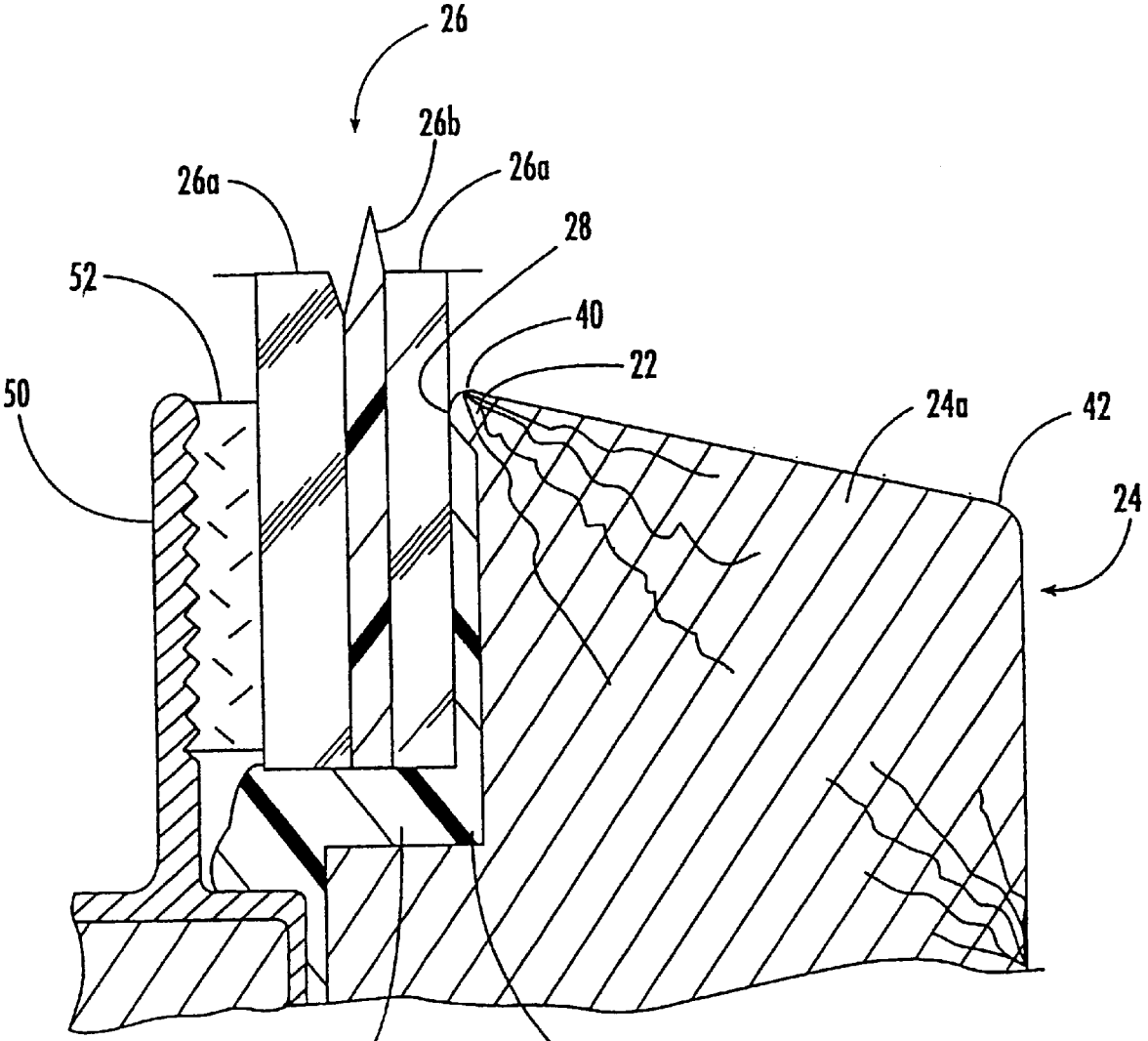
FIG. 2 is a greatly enlarged cross-sectional view taken along lines 2—2 of FIG. 1*a*.
Figure 3:
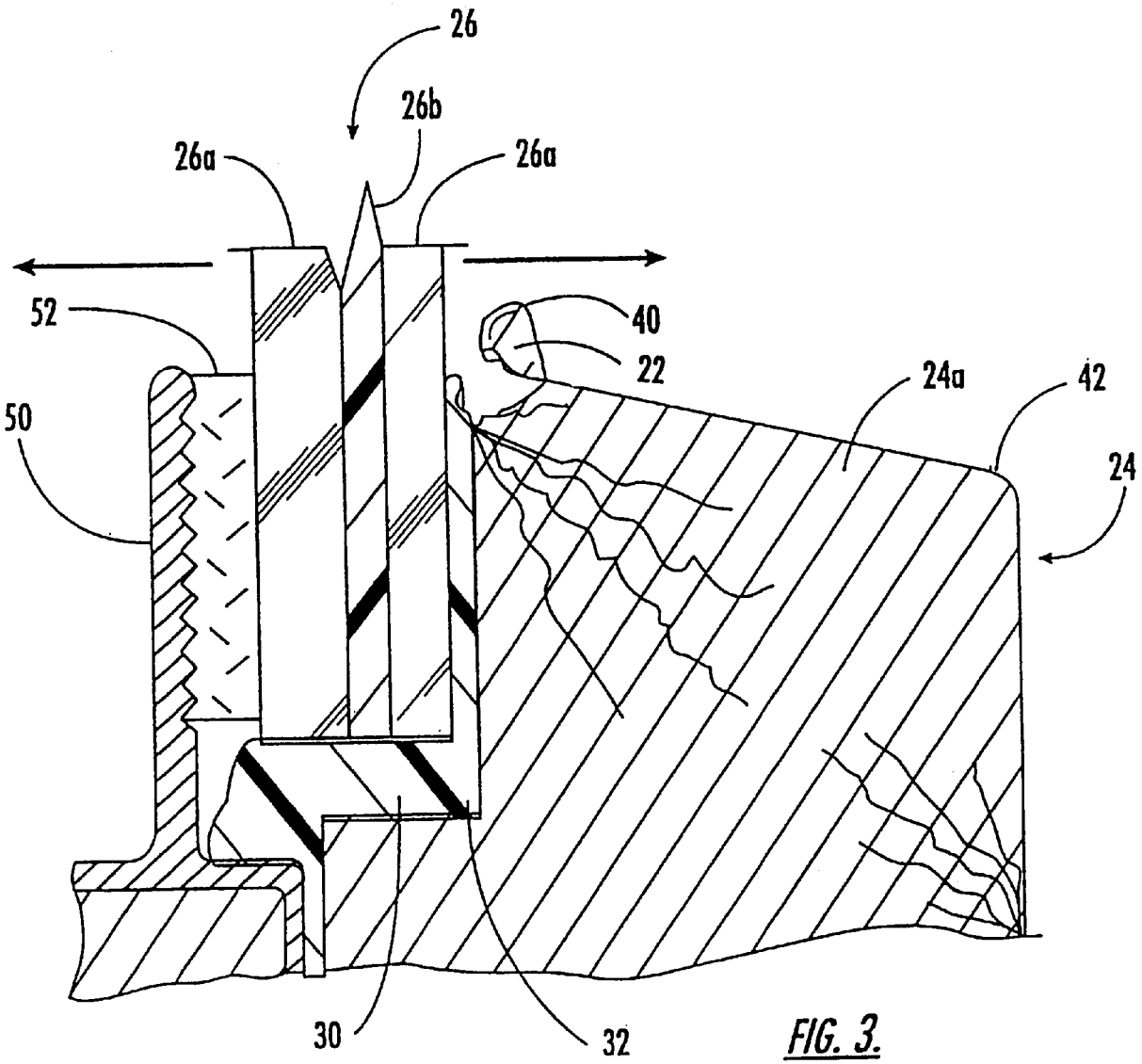
FIG. 3 is a greatly enlarged cross-sectional view similar to FIG. 2, but showing fracturing of the aesthetic sacrificial member as when the reinforced transparent panel is subjected to pressure cycling.

Referring to FIGS. 1–3, the aesthetic sacrificial wood member 22 in accordance with the present invention is now described. In the illustrated embodiment, the aesthetic sacrificial member 22 is incorporated in a casement window 20, as shown in FIG. 1*a*. Those of skill in the art will readily recognize that the aesthetic sacrificial member 22 may be used on other window types.

In another embodiment, the aesthetic sacrificial member 22 is incorporated in a glass door 23, as shown in FIG. 1*b*. Those of skill in the art will also readily recognize that the aesthetic sacrificial member 22 may be used on other door types, such as sliding glass doors. The aesthetical sacrificial member 22 is substantially the same for the casement window 20 and the glass door 23. Those of skill in the art will understand that the aesthetic sacrificial member can be used in other applications as well, such as single or double hung windows, hopper windows, or fixed frame windows. Accordingly, for ease of understanding, the discussion herein is directed to only the casement window 20.

More particularly, the casement window 20 includes a wood sash 24 carrying at least one reinforced transparent panel 26. The aesthetic sacrificial member 22 is integrally formed in the wood sash 24 along an interface 28 with the glass panel 26, as best shown in FIGS. 2 and 3. The aesthetic sacrificial member 22 extends outwardly from a body portion 24*a* of the wood sash 24 to define a cavity 30 between an adjacent portion of the wood sash 24 and the reinforced transparent panel 26. A body of sealant material 32 is placed in the cavity 30. As will be explained in more detail herein, the aesthetic sacrificial member 22 fractures from the body portion 24*a* of the wood sash 24 during hurricane force winds to permit the reinforced transparent panel 26 to move within the wood sash 24 to absorb energy of pressure cycling that occurs during hurricane force winds. Movement of the reinforced transparent panel 26 allows the window 20 to meet the rigorous hurricane standards, and to resist damage in the event of a hurricane. In addition, the aesthetic sacrificial member 22 covers the sealant material 32 to provide a pleasing appearance consistent with the quality of the wood sash 24.

Viewed from the exterior, as shown in FIG. 1*a*, the window 20 includes a generally rectangular wood sash 24 carried by a frame 25. The frame 25 is positioned within an opening of a structure 21. The wood sash 24 carries at least one reinforced transparent panel 26. The reinforced transparent panel 26 may preferably be a laminated glass including two glass panes 26*a* joined together by a laminating plastic layer 26*b* as would be readily appreciated by those skilled in the art. For example, the glass may be SENTRYGLAS® as offered by DuPont. Other impact resistant laminated glass configurations are also contemplated by the invention. For example, the transparent panel 26 may be formed entirely of plastic. The actual number of reinforced transparent panels in a particular window or door may be more than one as will be readily understood by those skilled in the art.

An exterior aluminum cladding 50 is positioned on an external side of the wood sash 24. A body of sealant material 52 of a type as will be readily appreciated by those skilled in the art is placed around the edges of the reinforced transparent panel 26 in between the aluminum cladding 50 and the reinforced transparent panel 26. The aluminum cladding 50 provides a decorative trim to cover the sealant material 52. The exact shape and dimensions of the aluminum cladding 50 will vary depending on the particular window design. The cladding may also be a vinyl cladding as will be readily understood by those skilled in the art.

The aesthetic sacrificial member 22 is preferably in the form of a lip which presses against the reinforced transparent panel 26. The cavity 30 is filled with a body of sealant material 32 of a type as will be readily appreciated by those skilled in the art. The cavity 30 defined below the aesthetic sacrificial member 22 can hold a relatively large amount of sealant material 32 to withstand the forces described above.

The aesthetic sacrificial member 22 extends along the interior interface to hide the body of sealant material 32 from view, and also provides a smooth surface for painting. The aesthetic sacrificial member 22 includes a rounded over surface 40 to reduce the likelihood of the wood splintering as would be understood by those skilled in the art. In addition, the aesthetic sacrificial member 22 has a slightly upward slope to its lower surface portion 42 to encourage fracturing when the reinforced transparent panel 26 is subjected to severe pressure cycling, as shown in FIG. 3. The slope also allows more sealant contact with the transparent panel.

Another aspect of the invention relates to a method for making a window or door including the aesthetic sacrificial member 22 as described above. The method preferably includes forming the wood sash 24 to have an aesthetic sacrificial member 22 extending outwardly from a body portion 24*a* therefrom to contact the at least one reinforced transparent panel 26 at an interface 28 therewith. The body portion 24*a* and aesthetic sacrificial member 22 are integrally formed of wood. The body portion 24*a* is spaced from an adjacent portion of the reinforced transparent panel 26 to define a cavity 30. The method may further include the step of positioning sealant material 32 within the cavity 30. The sealant material 32 is covered from view by the aesthethic sacrificial member 22. The aesthetic sacrificial member 22 fractures from the body portion 24*a* during hurricane force winds to permit the reinforced transparent panel 26 to move within the wood sash 24 to absorb energy of pressure cycling that occurs during hurricane force winds. As will readily be appreciated by those skilled in the art, the body portion 24*a* may be joined to other portions of the sash, not shown, to provide the entire sash.

Other related hurricane resistant windows and/or doors disclosed in copending patent applications filed concurrently herewith entitled HURRICANE FORCE WIND RESISTANT SLIDING GLASS DOOR ASSEMBLY AND ASSOCIATED METHODS; and HURRICANE FORCE WIND RESISTANT CASEMENT WINDOW AND ASSOCIATED METHODS, having respective attorney work docket numbers 59523 and 59544, the entire disclosures of which are incorporated herein in their entirety by reference.

Many modifications and other embodiments of the invention will come to the mind of one skilled in the art having the benefit of the teachings presented in the foregoing descriptions and the associated drawings. Therefore, it is to be understood that the invention is not to be limited to the specific embodiments disclosed, and that modifications and embodiments are intended to be included within the scope of the appended claims.

That which is claimed:

1. A window or door resistant to hurricane force winds comprising:

a wood sash;

at least one reinforced transparent panel carried by said wood sash;

said wood sash comprising a body portion and an integrally formed aesthetic sacrificial member extending outwardly therefrom to contact said at least one reinforced transparent panel at an interface therewith, said body portion being spaced from an adjacent portion of said at least one reinforced transparent panel to define a cavity beneath said aesthetic sacrificial member; and sealant material in the cavity, and being covered from view by said aesthethic sacrificial member;

said aesthetic sacrificial member fracturing from said body portion during hurricane force winds to permit said at least one reinforced transparent panel to move within said wood sash to absorb energy of pressure cycling that occurs during hurricane force winds.

2. A window or door according to claim 1, wherein said aesthetic sacrificial member is in the shape of a lip pressing against said at least one reinforced glass panel.

3. A window or door according to claim 1, wherein said aesthetic sacrificial member is on an interior portion of said wood sash.

4. A window or door according to claim 3, further comprising:

a cladding on an exterior portion of said wood sash; and sealant material between said cladding and an adjacent portion of said at least one reinforced glass panel.

5. A window or door according to claim 1, wherein said aesthetic sacrificial member has a rounded over surface to reduce wood splintering.

6. A window or door according to claim 1, wherein said aesthetic sacrificial member has a continuous smooth exterior surface.

7. A window or door according to claim 1, wherein said at least one reinforced transparent panel comprises laminated glass.

8. A window or door according to claim 7, wherein said laminated glass comprises at least one plastic reinforcing layer and at least one glass layer.

9. A wood sash comprising:

a wood body portion; and an integrally formed wood aesthetic sacrificial member extending outwardly from said wood body portion to contact at least one reinforced transparent panel at an interface therewith;

said wood body portion to be spaced from an adjacent portion of the at least one reinforced transparent panel to define a cavity beneath said wood aesthetic sacrificial member;

the cavity for holding sealant material covered from view by said wood aesthetic sacrificial member;

said wood aesthetic sacrificial member fracturing from said wood body portion during hurricane force winds to permit the at least one reinforced transparent panel to move to absorb energy of pressure cycling that occurs during hurricane force winds.

10. A wood sash according to claim 9, wherein said wood aesthetic sacrificial member is in the shape of a lip pressing against the at least one reinforced glass panel.

11. A wood sash according to claim 9, wherein said wood aesthetic sacrificial member is on an interior portion of the wood sash.

12. A wood sash according to claim 11, further comprising:

a cladding on an exterior portion of said wood sash; and sealant material between said cladding and an adjacent portion of the at least one reinforced transparent panel.

13. A wood sash according to claim 9, wherein said wood aesthetic sacrificial member has a rounded over surface to reduce wood splintering.

14. A wood sash according to claim 9, wherein said wood aesthetic sacrificial member has a continuous smooth exterior surface.

* * * * *